US010450111B2

(12) United States Patent
Albrecht et al.

(10) Patent No.: US 10,450,111 B2
(45) **Date of Patent: *Oct. 22, 2019**

(54) CONTAINER

(71) Applicant: WELLS ENTERPRISES, INC., Le Mars, IA (US)

(72) Inventors: David D. Albrecht, Le Mars, IA (US); Kaye D. Van Genderen, Laurens, IA (US)

(73) Assignee: Wells Enterprises, Inc., LeMars, IA (US)

( * ) Notice: Subject to any disclaimer, the term of this patent is extended or adjusted under 35 U.S.C. 154(b) by 542 days.

This patent is subject to a terminal disclaimer.

(21) Appl. No.: 15/265,555

(22) Filed: Sep. 14, 2016

(65) Prior Publication Data

US 2017/0001765 A1 Jan. 5, 2017

Related U.S. Application Data

(63) Continuation of application No. 13/960,464, filed on Aug. 6, 2013, now abandoned, which is a (Continued)

(51) Int. Cl.

| | |
|---|---|
| ***B65D 85/78*** | (2006.01) |
| ***B65D 43/02*** | (2006.01) |
| ***B65D 51/16*** | (2006.01) |

(52) U.S. Cl.

CPC ..... *B65D 43/0266* (2013.01); *B65D 43/0212* (2013.01); *B65D 51/1627* (2013.01); (Continued)

(58) Field of Classification Search

CPC ..... B65D 85/78; B65D 43/0266; B65D 43/0212; B65D 51/1627

(Continued)

(56) References Cited

U.S. PATENT DOCUMENTS

| | | | |
|---|---|---|---|
| 2,027,430 | A | 1/1936 | Hansen |
| 3,047,177 | A | 7/1962 | Poitras et al. |

(Continued)

FOREIGN PATENT DOCUMENTS

| | | |
|---|---|---|
| CA | 2019225 | 12/1992 |
| DM | 072852 | 2/2012 |

(Continued)

OTHER PUBLICATIONS

Correspondence from Shimokaji & Associates dated Nov. 27, 2007 (47 pages).

(Continued)

*Primary Examiner* — King M Chu

(74) *Attorney, Agent, or Firm* — Barnes & Thornburg LLP

(57) ABSTRACT

The current invention provides a container, a lid, a combination of the two, and a method of using the same. The container has a base and a sidewall extending upward from the base forming a continuous sidewall around the base. The upper portion of the sidewall has a rim and a skirt around the perimeter. The skirt has a removable tear tab to allow access to a lid for removing the lid from the container. The lid also has vents for air to exit the container, thereby preventing rising of the lid in low pressure areas. The vents further prevent entry of air into the container when the sealed container is taken to areas of higher pressure. A method of filling the container leaving an air gap between the product and the lid and utilizing the aforementioned vents is also provided.

16 Claims, 8 Drawing Sheets

Related U.S. Application Data continuation of application No. 11/227,594, filed on Sep. 15, 2005, now Pat. No. 8,528,770.

(52) U.S. Cl.
CPC ..... *B65D 85/78* (2013.01); *B65D 2543/0074* (2013.01); *B65D 2543/00083* (2013.01); *B65D 2543/00222* (2013.01); *B65D 2543/00296* (2013.01); *B65D 2543/00509* (2013.01); *B65D 2543/00537* (2013.01); *B65D 2543/00555* (2013.01); *B65D 2543/00805* (2013.01); *B65D 2543/00842* (2013.01)

(58) Field of Classification Search
USPC ..... 220/266
See application file for complete search history.

(56) References Cited

U.S. PATENT DOCUMENTS

| | | | | |
|---|---|---|---|---|
| 3,179,283 | A | | 4/1965 | Amberg |
| 3,339,786 | A | | 9/1967 | Biglin |
| 3,498,495 | A | | 3/1970 | Davis |
| 3,688,942 | A | | 9/1972 | Mitchell et al. |
| 3,809,280 | A | | 5/1974 | Park et al. |
| 3,836,042 | A | | 9/1974 | Petitto |
| 3,858,748 | A | | 1/1975 | Marco |
| 3,931,890 | A | | 1/1976 | Davis |
| 4,024,976 | A | | 5/1977 | Acton |
| 4,111,329 | A | | 9/1978 | Lampman |
| 4,190,175 | A | | 2/1980 | Allen |
| 4,212,409 | A | | 7/1980 | Jeppsson |
| 4,296,871 | A | | 10/1981 | Andersson |
| 4,346,832 | A | | 8/1982 | Werner |
| 4,385,711 | A | | 5/1983 | Bowen |
| 4,390,113 | A | | 6/1983 | Bird |
| 4,408,698 | A | | 10/1983 | Ballester |
| 4,422,559 | A | | 12/1983 | Landis |
| 4,423,822 | A | | 1/1984 | Powalowski |
| 4,520,943 | A | | 6/1985 | Nielsen |
| 4,555,042 | A | | 11/1985 | Rathbun |
| 4,574,974 | A | | 3/1986 | von Holdt |
| 4,711,364 | A | | 12/1987 | Letica |
| 4,759,465 | A | | 7/1988 | Landis |
| D297,709 | S | | 9/1988 | Willerup |
| 4,770,318 | A | | 9/1988 | Earl |
| 4,795,056 | A | | 1/1989 | Meyers |
| 4,796,771 | A | | 1/1989 | Stettler |
| 4,966,302 | A | | 10/1990 | Hjordie |
| 4,986,430 | A | | 1/1991 | Dutt |
| 5,027,969 | A | | 7/1991 | Lesquir |
| 5,027,972 | A | | 7/1991 | Bartholomew |
| 5,052,574 | A | | 10/1991 | McKinnon et al. |
| 5,193,711 | A | | 3/1993 | Hirata et al. |
| 5,219,087 | A | | 6/1993 | Christensson |
| 5,249,694 | A | | 10/1993 | Nelson |
| 5,303,839 | A | | 4/1994 | Blumenschein |
| 5,307,948 | A | * | 5/1994 | Blackburn ..... B65D 43/0212 220/266 |
| D353,766 | S | | 12/1994 | Thorso |
| 5,377,860 | A | | 1/1995 | Littlejohn et al. |
| 5,377,861 | A | | 1/1995 | Landis |
| 5,409,128 | A | | 4/1995 | Mitchell |
| 5,411,160 | A | | 5/1995 | Goulet et al. |
| D359,903 | S | | 7/1995 | Arshinoff et al. |
| 5,437,386 | A | | 8/1995 | Von Holdt |
| 5,464,112 | A | | 11/1995 | Guillot |
| 5,490,827 | A | | 2/1996 | Van de Geijn et al. |
| 5,505,325 | A | | 4/1996 | Thompson et al. |
| 5,511,680 | A | | 4/1996 | Kinne |
| 5,593,060 | A | | 1/1997 | Przytulla |
| 5,593,063 | A | | 1/1997 | Claydon et al. |
| 5,626,251 | A | | 5/1997 | Luburic et al. |
| 5,641,085 | A | | 6/1997 | Lonbardo |
| 5,653,382 | A | | 8/1997 | Van de Geijn et al. |
| 5,658,228 | A | | 8/1997 | Van de Geijn et al. |
| D383,671 | S | | 9/1997 | Phillips |
| 5,669,549 | A | | 9/1997 | Robertson |
| 5,725,120 | A | | 3/1998 | Ramsey et al. |
| 5,785,203 | A | | 7/1998 | Arshinoff et al. |
| 5,804,237 | A | | 9/1998 | Diamond et al. |
| 5,960,979 | A | | 10/1999 | Van Den Brink et al. |
| D418,409 | S | | 1/2000 | Hampshire |
| 6,164,484 | A | | 12/2000 | Fiore et al. |
| 6,257,435 | B1 | | 7/2001 | Chedister et al. |
| D447,688 | S | | 9/2001 | Jalet et al. |
| D448,291 | S | | 9/2001 | Melhede |
| D451,022 | S | | 11/2001 | Lueders |
| D469,320 | S | | 1/2003 | Pettaweebuncha |
| D470,768 | S | | 2/2003 | Melhede |
| 6,672,595 | B2 | | 1/2004 | Park |
| 7,165,695 | B2 | * | 1/2007 | Choi ..... B25H 3/02 220/254.3 |
| 8,240,504 | B2 | | 8/2012 | Fallen |
| 2004/0118848 | A1 | | 6/2004 | Marshall |
| 2004/0232154 | A1 | | 11/2004 | Smith et al. |
| 2005/0006449 | A1 | | 1/2005 | D'Amato |
| 2006/0266750 | A1 | | 11/2006 | Lesquir |
| 2006/0273091 | A1 | | 12/2006 | Hornke et al. |

FOREIGN PATENT DOCUMENTS

| | | | |
|---|---|---|---|
| DM | 077922 | | 8/2012 |
| GB | 2235920 | * | 9/1989 |
| GB | 2235920 | | 3/1991 |

OTHER PUBLICATIONS

HyVee Potato Salad Container (5 photos), marked with U.S. Pat. No. 6,027,969 and CA 2,019,225.

Photograph of Edy's DIBS Bite Sized Ice Cream Snacks Container, Edy's Grand Ice Cream, Oakland, California (one page).

"Valhalla Norwegian Ice Cream", Valhalla Norwegian Ice Cream Company, Brandon Florida, Aug. 3, 2004 (one page).

* cited by examiner

CONTAINER

CROSS REFERENCE TO RELATED APPLICATIONS

This application is a Continuation of U.S. Ser. No. 13/960,464, filed Aug. 6, 2013, which is a Continuation of U.S. Ser. No. 11/227,594, filed Sep. 15, 2005, now U.S. Pat. No. 8,528,770. The disclosures set forth in the referenced applications are incorporated herein by reference in their entireties.

BACKGROUND OF THE INVENTION

This invention relates to an improved container. This invention will be shown and described as a container for holding, shipping and storing ice cream, however other products may be used with this invention.

Products, such as ice cream, are typically packed, shipped, and stored in cardboard containers. One problem with these containers is that they are not structurally sound. Ice cream must fill the entire container in order to give the cardboard container structural strength for stacking multiple layers of the ice cream containers.

Another problem with this type of container is that as the ice cream thaws and becomes more liquefied the container begins to soften and can fall apart. Thus, a more structurally sound ice cream container is desirable.

Another problem with traditional ice cream containers is that, as mentioned above, they are traditionally filled clear to the rim with ice cream, and then a lid is placed on top of the ice cream container. When shipments of ice cream in this type of container are shipped over high elevation areas, the air and ice cream in the containers begins to expand as they reach higher elevations. Thus, the lids tend to be either deformed, or pushed completely up off of the top of the container. As a result, ice cream containers may be opened and the contents not fit for consumption. Therefore, a container which accommodates for this problem of shipping ice cream or other frozen products over high elevation areas is desirable.

In view of the foregoing, it is a primary feature of advantage of the current invention to provide an improved container.

Another feature or advantage of the current invention is a container which is tamper resistant.

Another feature or advantage of the current invention is a container which indicates once the container has been opened after being factory sealed.

Another feature or advantage of the current invention is a container which structurally supports itself and is stackable.

Another feature or advantage of the current invention is a container which is useable for medium to low temperature applications.

Another feature of advantage of the current invention is a provision of a container which is efficient in operation, durable in use, and economical to manufacture.

A further feature or advantage of the current invention is a method of filling ice cream in a container to reduce overflow of ice cream when being shipped over high altitudes or low atmospheric pressures.

These and other features and advantages of the current invention will become apparent according to the claims and specification that follow.

BRIEF SUMMARY OF THE INVENTION

One aspect of the current invention is a container having a base and an integral sidewall extending upward from the base forming a continuous sidewall around the base with an integral upper seal rim at an upper portion of the sidewall for engaging a lid and a container skirt around an upper outside portion of the sidewall integrally connected between the sidewall and the upper seal rim. A tear tab is integrally and removably formed in the skirt and approximately parallel to the skirt. The tear tab is formed with a tear tab lever extending upward and outward from the tear tab allowing a user to pull downward and outward to separate the pull tab from the skirt.

Another aspect of the current invention is a container having an upper seal rib extending outward from and adjacent to the upper seal rim around the upper seal rim.

Another aspect of the current invention is a lid for sealing a container comprising a continuous inner wall with a lid skirt integrally formed around the inner wall forming a lid channel. A continuous pressure rib is formed inside the lid channel around the lid adjacent the inner wall and the lid channel. A continuous rim shoulder is formed inside the lid channel adjacent the lid channel and the lid skirt and a non-continuous seal rib is formed inside the lid channel around the periphery of the lid channel forming one or more vents.

Another aspect of the current invention is a lid having one or more lift tabs integrally formed with and extending outward from the lid skirt.

Another aspect of the current invention is a lid wherein the lid skirt extends greater than 0.1 inches below the inner wall.

Another aspect of the current invention is a combination of the lid and container wherein the inner wall of the lid is above a fill line within the container on the sidewall providing an air gap between the product within the container and the lid when the container is filled to about the fill line and the product and the lid is placed on the container to seal the product within the container.

Another aspect of the current invention is a method of filling a container with a frozen product and preventing the frozen product from expanding so much as to pop a lid off of the container when shipped at high altitudes, the method comprised of filling the container with the product to a fill line within the container, placing a sealable lid on the container so that there is an air gap between the product and the lid and providing one or more vents along a seal on the lid which allows air to escape the air gap to outside the container as the pressure inside the air gap increases due to increases in altitude, but the seals preventing air from re-entering the air gap.

DETAILED DESCRIPTION OF THE PREFERRED EMBODIMENT

The preferred embodiment of the container 10 and lid 100 which assemble together for this invention are shown in FIGS. 1-22. Both the container 10 and lid 100 are preferred to be made of food grade polypropylene, but any other type of material can be used with this invention.

Figure 1:
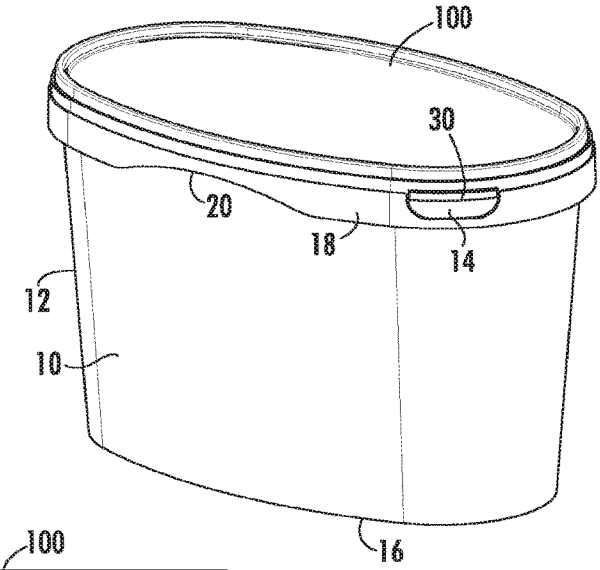
FIG. 1 is a perspective view of one embodiment of the container and lid of the current invention.
Figure 2:
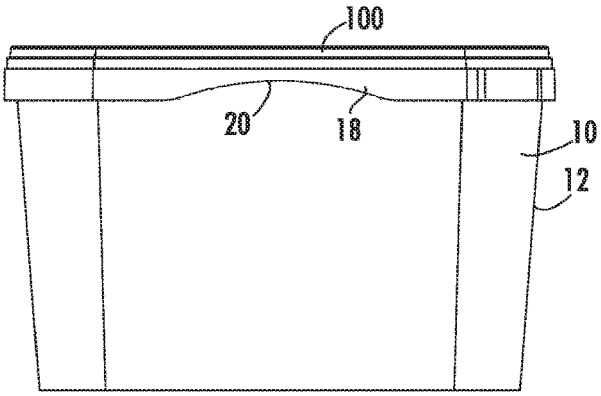
FIG. 2 is a front view of the container and lid of FIG. 1.
Figure 3:
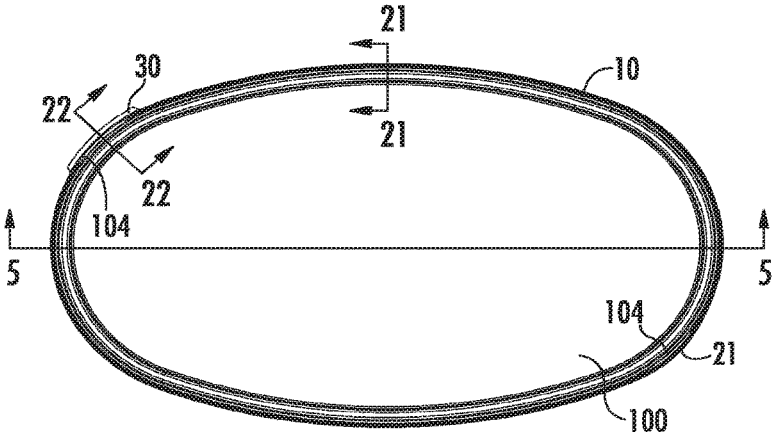
FIG. 3 is a top view of the container and lid of FIG. 1.
Figure 4:
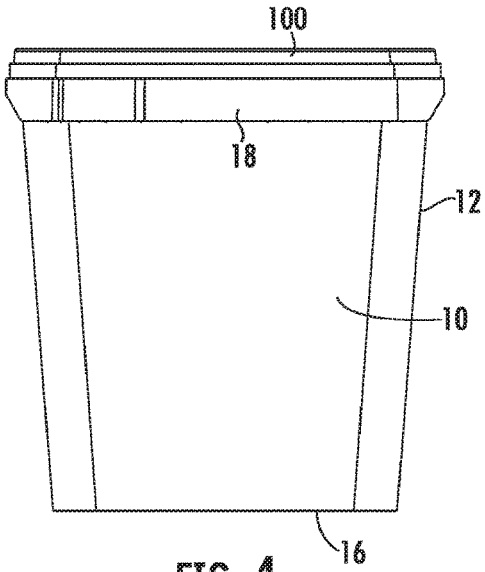
FIG. 4 is a side view of the container and lid of FIG. 1.

A sidewall 12 extends upward from the base 16 and around the base, thereby creating a product holding portion of the container 10. The container 10 of this invention can be of any size or shape. However, it is preferred that a top view of the container 10 create an oval shape as shown in FIG. 3. Additionally, the shape of the container 10 is preferred to be slightly sloped for ease of molding the container 10 and stacking or nesting the empty container 10. This type of stacking or nesting ids also preferred for the lid 100.

The top portion of the sidewall 12 has both an upper seal rim 24 and a container skirt 18 formed around the outside edge of the sidewall 12. The upper seal rim 24 helps fit into a lid channel 112 of the lid 100 and forms a seal between the lid 100 and the container 10. Therefore, the upper seal rim 24 should be properly sized in height and thickness depending on the lid channel 112 of the lid 100 which is to be used with the container 10.

A container skirt 18 extends outward from the sidewalls 112 around the upper portion of the container 10 and adds structural strength to the container 10 having a portion of the skirt 18 horizontal and a portion of the skirt 18 relatively vertical. However, the relatively vertical portion of the skirt 18 should still allow for a draft for easy mold release. Additionally, the mold skirt 18 adds strength to the container 10 by the use of multiple skirt ribs 22 integrally formed between the skirt 18 and the sidewall 12.

Figure 21:
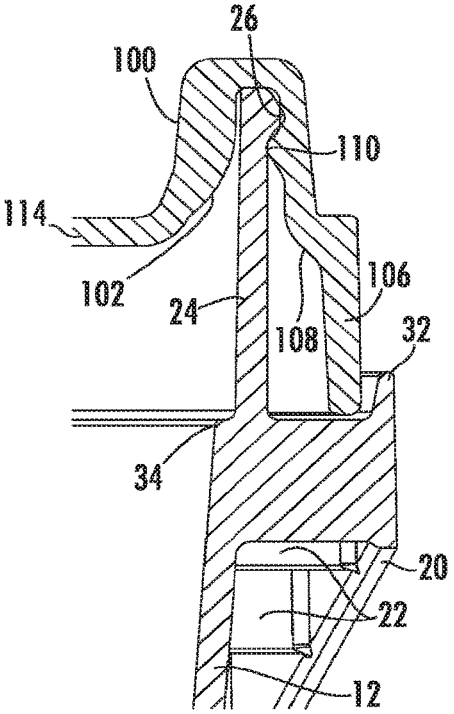
FIG. 21 is an enlarged sectional view taken along lines 21-21 of FIG. 3 with the container and lid assembled.

The container skirt 18 also has a tamper resistant rim 32 extending upward from the skirt 18 allowing a lid skirt 106 to remain between the upper seal rim 24 and the tamper resistant rim 32 when the container 10 is engaged by a lid 100. This is best seen in FIG. 21. This prevents a person from easily lifting up on the lid 100 and removing it from the container 10 in places other than the tear tab 14.

The container skirt 18 also preferably has a container skirt indent 20. The container skirt indent 20 allows for ease carrying a cold damp container 10, however, is not necessary for the current invention.

Figure 8:
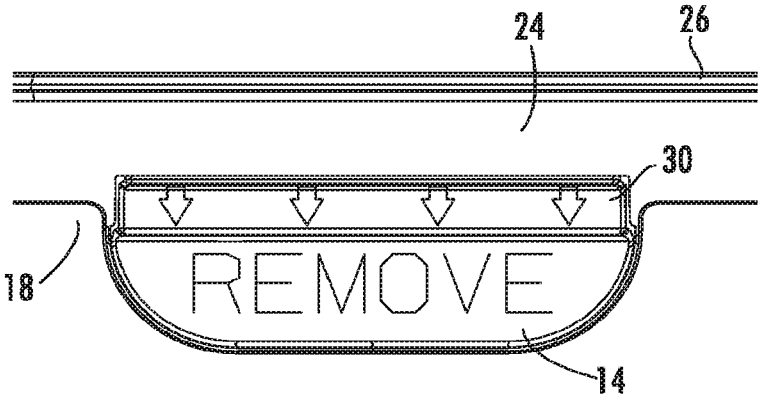
FIG. 8 is a front view of one embodiment of the tear tab of the current invention.
Figure 9:
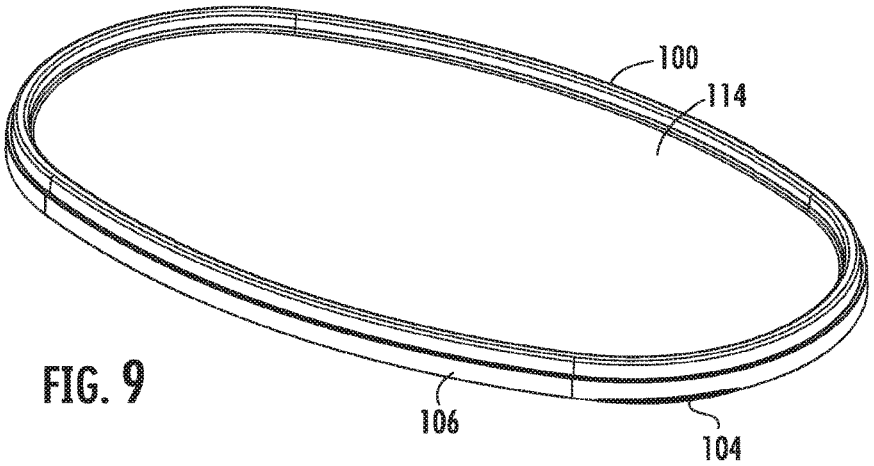
FIG. 9 is a top perspective view of one embodiment of the lid of the current invention.
Figure 10:
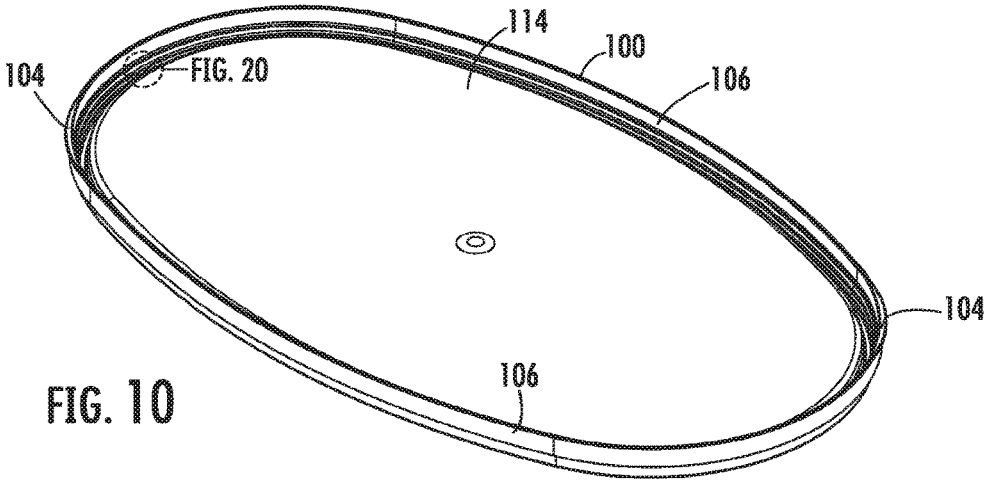
FIG. 10 is a bottom perspective view of the lid of FIG. 9.
Figure 11:
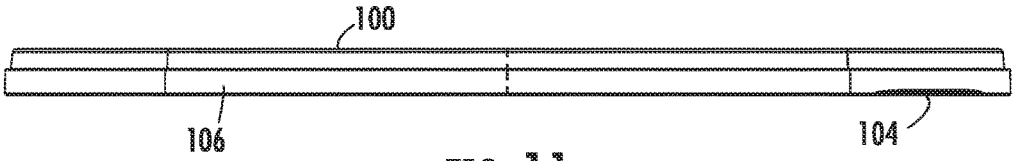
FIG. 11 is a side view of the lid of FIG. 9.
Figure 12:
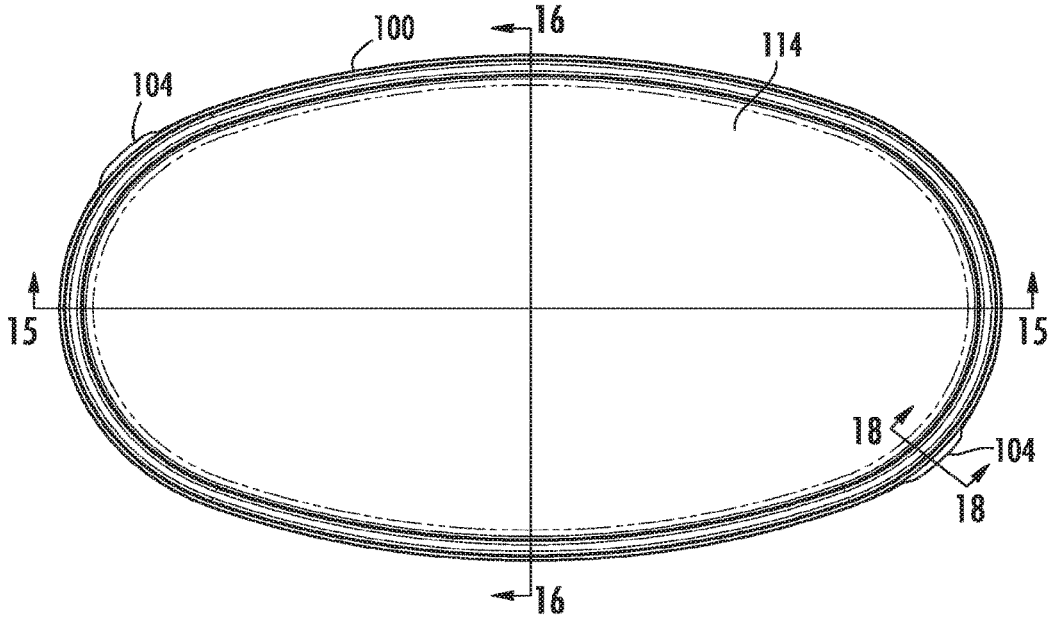
FIG. 12 is a top view of the lid of FIG. 9.
Figure 13:
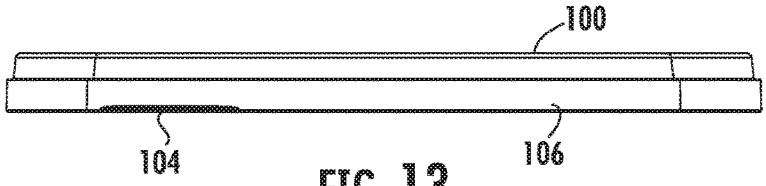
FIG. 13 is a side view of the lid of FIG. 9.
Figure 22:
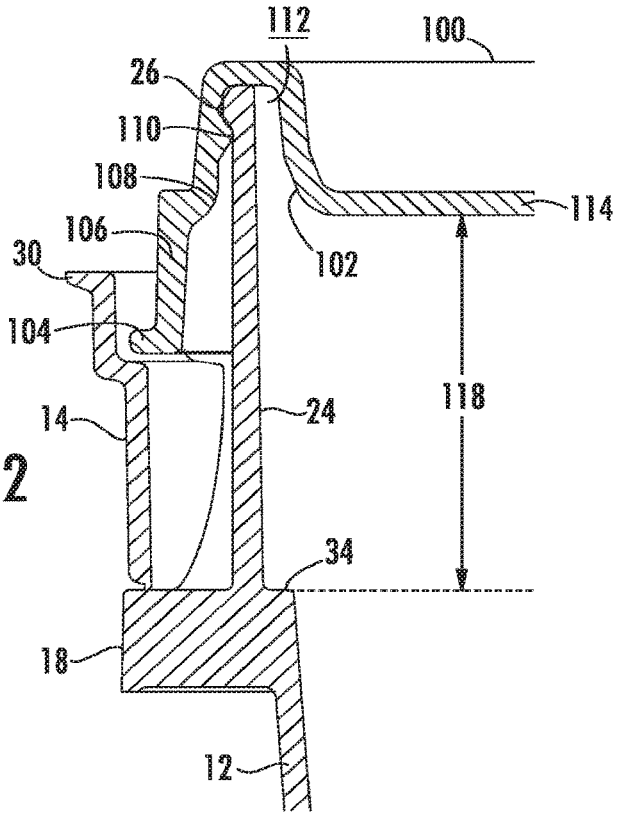
FIG. 22 is an enlarged partial sectional view taken along lines 22-22 of FIG. 3 with the container and lid assembled.

The container skirt 18 also has a tear tab 14. The tear tab 14 is also integrally formed with the container 10, however, as shown in FIGS. 8 and 22, the tear tab 14 is very thin where it attaches to the skirt 18 and is therefore easily torn outward and downward from the container 10 to be removed. Once the tear tab 14 is removed from the container 10, the user has access to the lid skirt 106 and possibly a lift tab 104 which is integrally formed with the lid skirt 106 to lift the lid 100 off of the container 10.

Additionally, the container skirt 18 preferably has one or more skirt protrusions 21, which is a portion of the skirt 18 which extends further out than the skirt 18, as shown in FIG. 3. The protrusions 21 allow the lid 100 to be made with multiple lift tabs 104. In other words, the skirt protrusion 21, as shown, is located axially opposite the tear tab 14 so that no matter how the lid 100 is oriented on the container 10, the lift tab 104 will not interfere with the tamper resistant rim 32. Thus, a proper fit of the lid 100 is assured. There should be at least as many protrusions 21 as there are lift tabs 104. In addition, the lift tabs 104 should orient with the protrusions 21.

To make removing the tear tab 14 easier, the tear tab 14 preferably has a tear tab lever 30 extending upward and outward from the tear tab 14, as best seen in FIGS. 8 and 22. The tear tab lever 30 covers the lift tab 104 and the lid skirt 106 when the tear tab 14 is in place on the container 10. Additionally, the tear tab lever 30, by extending upward and outward from the tear tab 14, allows easier access to grab a hold of the tear tab 14 for removing it. Furthermore, the tear tab lever 30 provides more leverage to aid in tearing out the tear tab 14.

Figure 5:
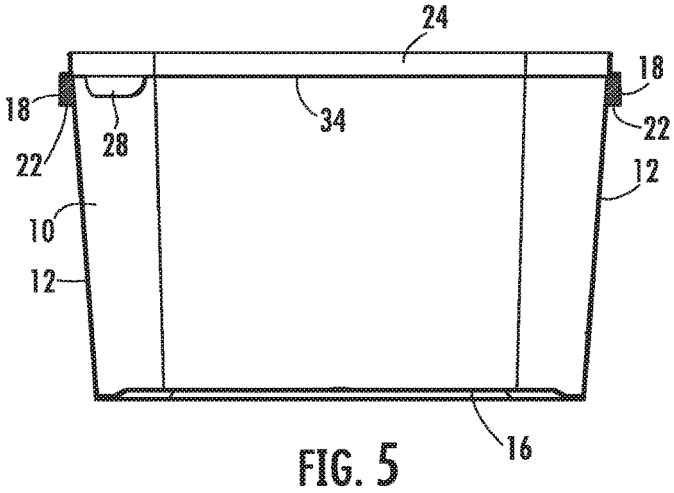
FIG. 5 is a sectional view of the container taken along lines 5-5 in FIG. 3.
Figure 6:
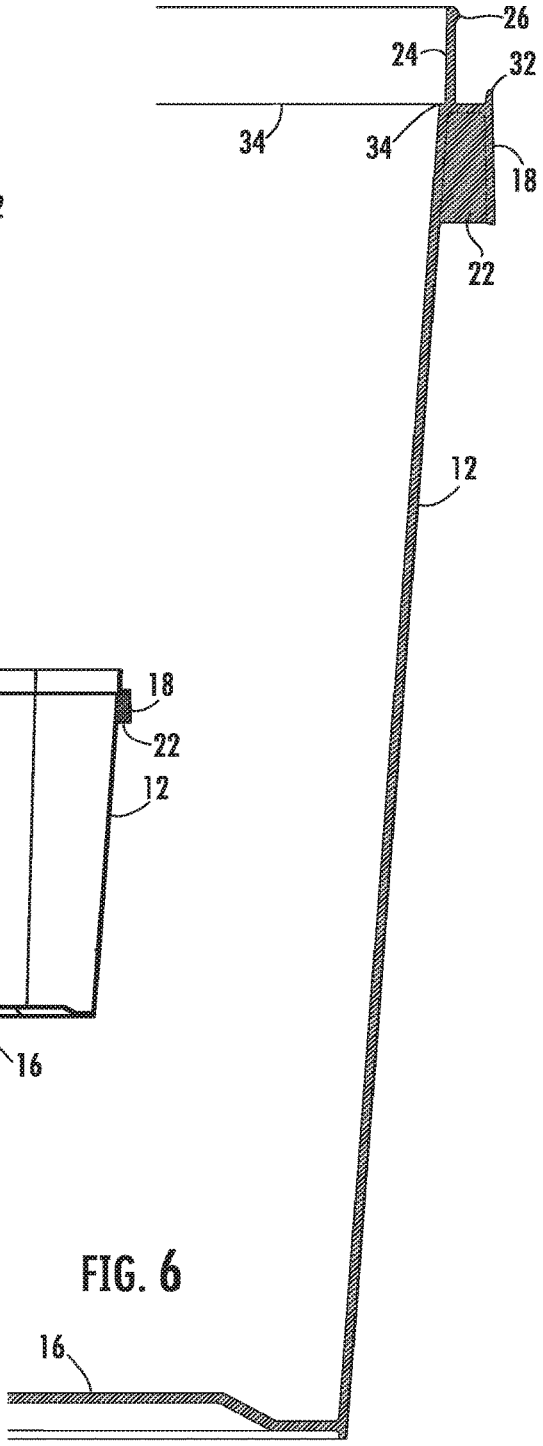
FIG. 6 is a partial enlarged view of the container in FIG. 5.
Figure 7:
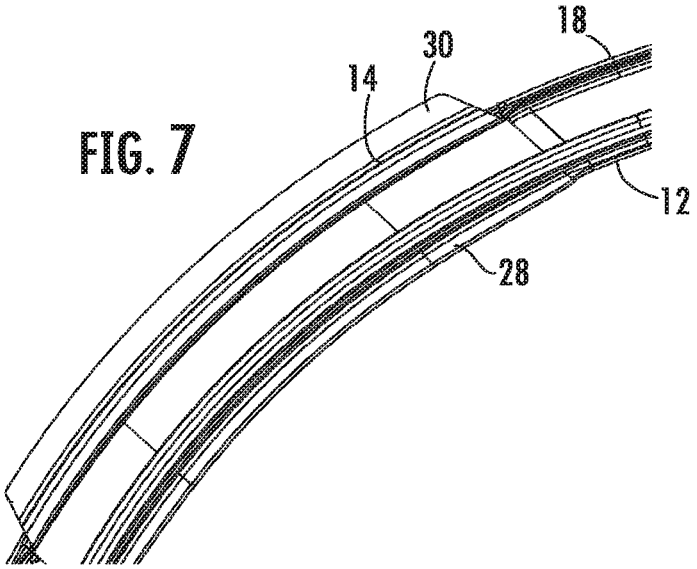
FIG. 7 is a top view of one embodiment of the tear tab of the current invention.

It is preferred, but not necessary to have an inner wall tear tab indent 28, as best seen in FIG. 5 on the inside of the sidewall 12 opposite the tear tab 14. Additionally, the inner portion of the sidewall 12 preferably has a fill line 34 for use as an indicator when filling the container 10 to help prevent overfilling the container 10, which in turn, reduces overflowing of frozen products, such as ice cream when taking them over high altitudes.

The upper seal rim 24 has an upper seal rim rib 26 around the outside upper portion of the upper seal rim 24. This upper seal rim rib 26 allows for the container 10 to interfere with a seal rib 110, preferably within the lid channel 112 of the lid 100. Therefore, as a lid 100 engages the container 10, a tight interference fit is formed between the upper seal rim rib and the seal rib 110 on the lid 100 thereby preventing easy removal of the lid 100 from the container 10. Both the lid 100 and the container 10 are preferably constructed of a relatively flexible material which flexes enough to allow the upper seal rim rib 26 and the seal rib 110 deflects out of the way to pass one another when the lid 100 is being placed onto the container 10. The frictional fit between the upper seal rim rib 26 and the seal rib 110 are best shown in FIGS. 21 and 22.

The lid 100 also preferably has a pressure rib 102 and a rim shoulder 108 for both guiding the upper seal rim 24 into the lid channel 112 and helping add additional material to the lid 100 thereby creating a tighter fit of the lid 100 on the container 10.

Figure 14:
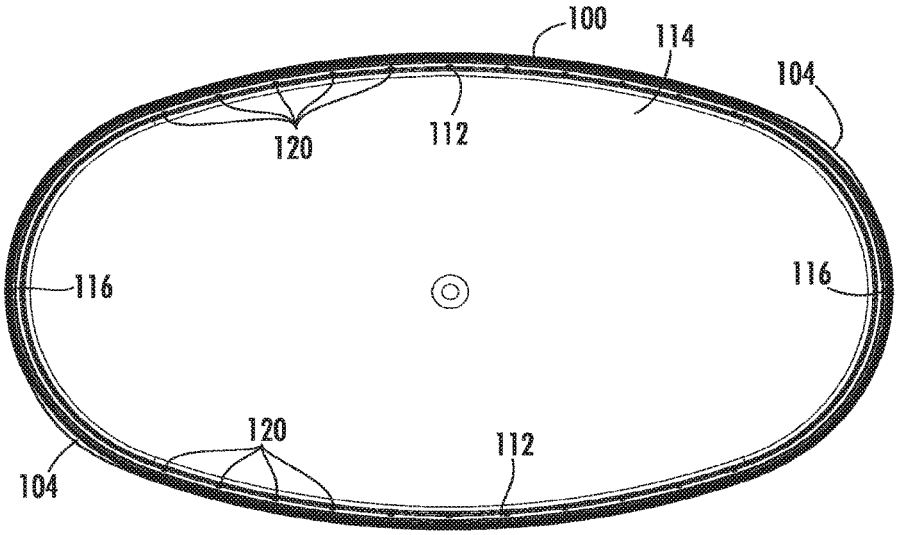
FIG. 14 is a bottom view of the lid of FIG. 9.
Figure 15:
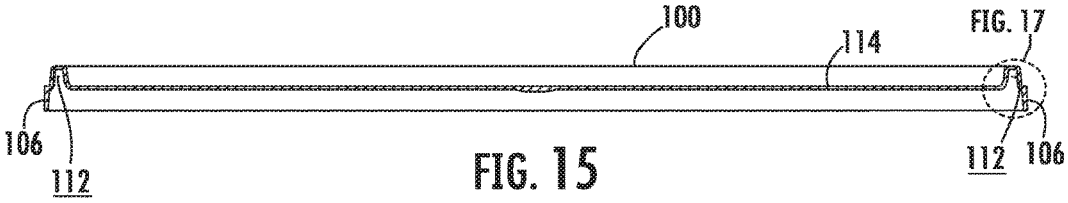
FIG. 15 is a sectional view taken along lines 15-15 of FIG. 12.
Figure 16:
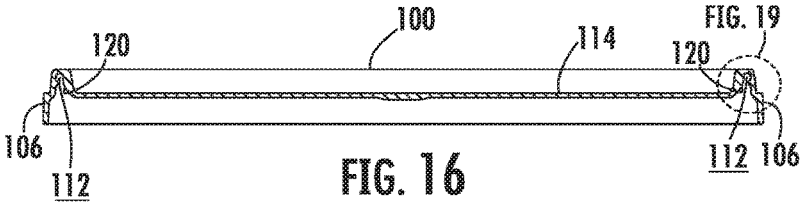
FIG. 16 is a sectional view taken along lines 16-16 of FIG. 12.
Figure 17:
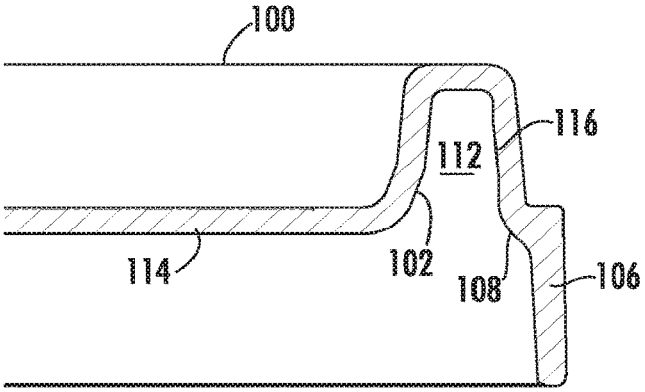
FIG. 17 is a partial enlarged view of FIG. 15.
Figure 18:
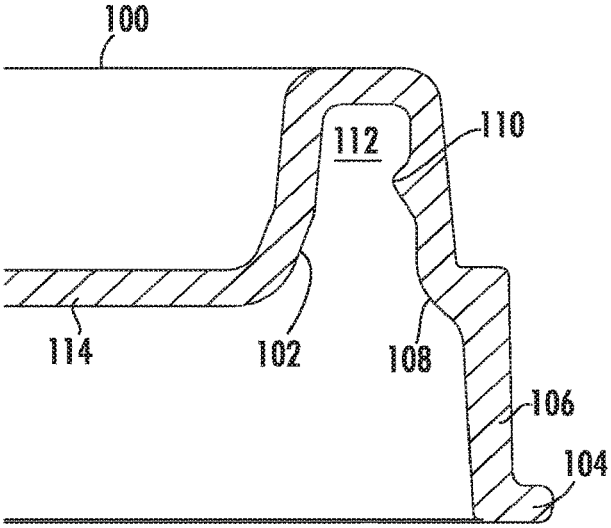
FIG. 18 is an enlarged partial sectional view taken along lines 18-18 of FIG. 12.
Figure 19:
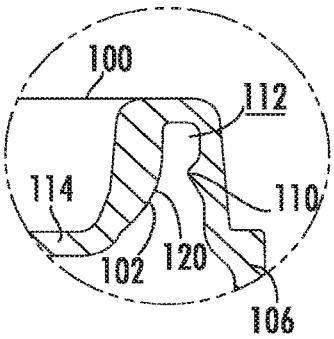
FIG. 19 is an enlarged partial sectional view of FIG. 16.
Figure 20:
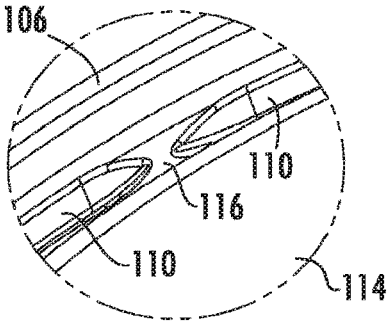
FIG. 20 is an enlarged partial view of FIG. 10.

The lid 100 preferably has a lid inner wall 114, which is a continuously formed surface within the lid skirt 106. Once again, the lid channel 112 should extend around the outside portion of the lid 100 between the lid inner wall 114 and the lid skirt 106. The lid channel 112 should be as deep and wide as necessary to create a good tight seal and fit with the upper seal rim 24 of the container 10. Additionally, the lid channel 112 may contain one or more inner channel vertical ribs 120 to help give strength to the lid 100 and also help create a tighter fit between the lid 100 and the container 10. Exemplary inner channel vertical ribs are best shown in FIG. 14.

As best shown in FIGS. 10, 14, 15, 17, and 20, the seal rib 110 is not continuous around the periphery of the lid 100 thereby creating one or more vents 116. The vents areas 116 seal between the lid 100 and the container 10 with the upper seal rim rib 26. However, the seal at the vent 116 allows air within an air gap 118 between a product within the container 10 and the lid 100, as shown in FIG. 22, to escape the air gap 118 as air pressure within the air gap 118 increases by having the air proceed out of the air gap 118 into the lid channel 112 and up and over the upper seal rim 24 and the upper seal rim rib 26 and outside of the container 10. Thus, when a container that is full of product to about the fill line 34 is transported to lower pressure areas, such as high altitudes, the pressure created within the air gap 118 can escape. This prevents either air or expanding product in low pressures from popping the lid 100 off of the container 110 at these low pressure areas. However, when going to high pressure areas, air cannot enter through the vent 116 because the pressure in the high pressure areas actually pushes the lid 100 tighter onto the container 10 preventing air from entering the air gap 118.

As shown above, a method of filling a container to a fill line 34 and placing a lid 100 onto the container 10 and thereby creating an air gap 118 between the product within the container 10 and the lid inner wall 114 of the lid 100 allows for expansion of the product without forcing the lid 100 off the container 10. Additionally, the container 10 and the lid 100 of this invention are structurally capable of stacking multiple units on top of one another, thereby not needing the structural support of a completely filled container such as cardboard ice cream containers.

Another advantage of the current invention is when the container is used with ice cream, the plastic container flexes a small amount when scooping ice cream out of the container from along the long axis of the container 10 thereby causing the container to widen and make it easier to scoop the product out of the container 10.

Another advantage of the current invention is that this container 10 and lid 100 are easily labeled for product identification with in-mold labels (not shown for clarity of showing the container), which are generally known in the art. The in-mold labels tend to add a less-smooth textured surface around the outside of the sidewall 12 and the lid inner wall 114. This textured surface caused by in-mold labeling creates an easier to grip container, especially when filled with ice cream which causes a slick wet outer surface of the container 10.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A product-holding container comprising:

a container body having a substantially symmetrical oval base and a sidewall extending upward from a perimeter of the base, the base extending along a width direction and a length direction perpendicular to the width direction, a width of the base defined along the width direction and a length of the base defined along the length direction, the length of the base being longer than the width of the base, the sidewall terminating in a seal rim having a rib extending outward from and adjacent to the seal rim, and the sidewall having opposing end portions spaced apart from one another along the length direction and opposing side portions spaced apart from one another along the width direction;

a substantially symmetrical oval lid including a lid surface forming a top of the lid and a lid skirt integrally formed around a perimeter of the lid surface, the lid skirt defining a lid channel configured to engage with the rib of the seal rim to mount the lid on the container body;

a container skirt integrally connected to the sidewall and extending around an outside portion of the sidewall proximate the seal rim, the container skirt including a horizontal portion extending outward from the sidewall and a vertical portion coupled to a distal end of the horizontal portion and spaced apart from the sidewall, a plurality of support ribs extending between the sidewall and the vertical portion of the container skirt and from the horizontal portion of the container skirt generally to a lower edge of the vertical portion of the container skirt, the vertical portion having a substantially continuous height along a perimeter of the sidewall adjacent the end portions and a varying height adjacent the side portions where the lower edge of the vertical portion is closer to the horizontal portion of the container skirt to define skirt indents, a height of the support ribs varying with the height of the vertical portion, the horizontal portion of the container skirt formed to define a recess proximate one of the end portions of the sidewall and configured to allow access to a perimeter edge of the lid skirt when the lid is mounted on the container body, and the container skirt formed to define a lid channel configured to receive the perimeter edge of the lid skirt to block access to the perimeter edge of the lid skirt outside of the recess when the lid is mounted on the container; and a tear-off tab frangibly connected to the container skirt to block access to the recess and configured to be removed at the selection of a user, the tear-off tab substantially aligned with the vertical portion of the container skirt to provide a substantially continuous outer surface of the container skirt around the perimeter of the sidewall.

2. The product-holding container of claim 1, wherein the horizontal portion of the container skirt is substantially continuous both when the tear-off tab is connected to the container skirt and after removal of the tear-off tab.

3. The product-holding container of claim 1, wherein the lid skirt is formed to define a non-continuous seal rib defining one or more air vents for venting air through the lid channel and configured to engage with the rib of the seal rim.

4. A product-holding container comprising:

a container body having a base and a sidewall extending upward from a perimeter of the base, the sidewall terminating in a seal rim having a rib extending outward from and adjacent to the seal rim;

a lid including a lid surface forming a top of the lid and a lid skirt integrally formed around a perimeter of the lid surface, the lid skirt defining a lid channel configured to engage with the rib of the seal rim to mount the lid on the container body;

a container skirt integrally connected to the sidewall and extending around an outside portion of the sidewall proximate the seal rim, the container skirt including a horizontal portion extending outward from the sidewall and a vertical portion coupled to a distal end of the horizontal portion and spaced apart from the sidewall, the horizontal portion of the container skirt formed to define a recess configured to allow access to a perimeter edge of the lid skirt when the lid is mounted on the container body, and the container skirt formed to define a lid channel configured to receive the perimeter edge of the lid skirt to block access to the perimeter edge of the lid skirt outside of the recess when the lid is mounted on the container; and a tear-off tab frangibly connected to the container skirt to block access to the recess and configured to be removed at the selection of a user, wherein the base is formed in a substantially symmetrical oval shape, wherein the base extends along a width direction and a length direction perpendicular to the width direction, wherein a width of the base is defined along the width direction and a length of the base is defined along the length direction, and wherein the length of the base is longer than the width of the base wherein the sidewall defines opposing end portions spaced apart from one another along the length direction and opposing side portions spaced apart from one another along the width direction, and wherein the vertical portion of the container skirt has a substantially continuous height along a perimeter of the sidewall adjacent the end portions and a varying height adjacent the side portions where the lower edge of the vertical portion is closer to the horizontal portion of the container skirt to define skirt indents.

5. The container of claim 4, wherein the base is formed in a rectangular shape having rounded corners.

6. The container of claim 4, wherein the recess is formed proximate one of the opposing end portions of the sidewall.

7. The container of claim 4, further comprising a plurality of support ribs extending between the sidewall and the vertical portion of the container skirt and from the horizontal portion of the container skirt generally to a lower edge of the vertical portion of the container skirt.

8. The container of claim 7, wherein a height of the support ribs varies with the height of the vertical portion.

9. The container of claim 4, wherein the lid is formed in a substantially symmetrical oval shape.

10. The container of claim 4, wherein the tear-off tab substantially aligns with the vertical portion of the container skirt to provide a substantially continuous outer surface of the container skirt around the perimeter of the sidewall.

11. The product-holding container of claim 10, wherein the horizontal portion of the container skirt is substantially continuous both when the tear-off tab is connected to the container skirt and after removal of the tear-off tab.

12. A product-holding container comprising:

a container body having a base and a sidewall extending upward from a perimeter of the base, the sidewall defining opposing end portions spaced apart from one another by opposing side portions that are longer than the end portions;

a lid including a lid surface forming a top of the lid and a lid skirt integrally formed around a perimeter of the lid surface, the lid skirt configured to engage with the sidewall to mount the lid on the container body;

a container skirt integrally connected to the sidewall and extending around an outside portion of the sidewall proximate an upper rim of the sidewall, the container skirt including a horizontal portion extending outward from the sidewall and a vertical portion coupled to a distal end of the horizontal portion and spaced apart from the sidewall, the horizontal portion of the container skirt formed to define a recess configured to allow access to a perimeter edge of the lid skirt when the lid is mounted on the container body, the vertical portion of the container skirt having a substantially continuous height along a perimeter of the sidewall adjacent the end portions and a varying height adjacent the side portions where the lower edge of the vertical portion is closer to the horizontal portion of the container skirt to define skirt indents; and a tear-off tab frangibly connected to the container skirt to block access to the recess and configured to be removed at the selection of a user.

13. The container of claim 12, wherein the container skirt is formed to define a lid channel configured to receive the perimeter edge of the lid skirt to block access to the perimeter edge of the lid skirt outside of the recess when the lid is mounted on the container.

14. The container of claim 13, further comprising a plurality of support ribs extending between the sidewall and the vertical portion of the container skirt and from the horizontal portion of the container skirt generally to a lower edge of the vertical portion of the container skirt.

15. The container of claim 14, wherein the tear-off tab substantially aligns with the vertical portion of the container skirt to provide a substantially continuous outer surface of the container skirt around the perimeter of the sidewall.

16. The container of claim 15, wherein the horizontal portion of the container skirt is substantially continuous both when the tear-off tab is connected to the container skirt and after removal of the tear-off tab.

* * * * *